US006570151B1

(12) United States Patent
Grosshans et al.

(10) Patent No.: US 6,570,151 B1
(45) Date of Patent: May 27, 2003

(54) METHODS AND APPARATUS TO CONTROL CHARGE NEUTRALIZATION REACTIONS IN ION TRAPS

(75) Inventors: Peter B. Grosshans, Franklin Park, NJ (US); Chad M. Ostrander, Austin, TX (US); Craig A. Walla, Fremont, CA (US)

(73) Assignee: Hitachi Instruments, Inc., San Jose, CA (US)

( * ) Notice: Subject to any disclaimer, the term of this patent is extended or adjusted under 35 U.S.C. 154(b) by 0 days.

(21) Appl. No.: 10/081,243

(22) Filed: Feb. 21, 2002

(51) Int. Cl.[7] ..... H01J 49/42
(52) U.S. Cl. ..... 250/282; 250/292
(58) Field of Search ..... 250/292, 281–283, 250/285, 249

(56) References Cited

U.S. PATENT DOCUMENTS 3,065,640 A 11/1962 Langmuir et al.
4,540,884 A 9/1985 Stafford et al.
RE34,000 E 7/1992 Syka et al.

OTHER PUBLICATIONS

Scott A. McLuckey, Gavin E. Reid and J. Mitchell Wells, "Ion Parking During Ion/Ion Reactions in Electrodynamic Ion Traps", Analytical Chemistry, vol. 74, No. 2, pp. 336–346, Jan. 15, 2002.

Scott A. McLuckey, James L. Stephenson, Jr. and Keiji G. Asano, "Ion/Ion Proton–Transfer Kinetics: Implications For Analysis Of Ions Derived From Electrospray Of Protein Mixtures", Analytical Chemistry, vol. 70, No. 6, pp. 1198–1202, Mar. 15, 1998.

Raymond E. March and Frank A. Londry, Chapter 2, "Theory Of Quadrupole Mass Spectrometry", pp. 25–48, published in "Practical Aspects Of Ion Trap Mass Spectrometry", vol. 1, edited by Raymond E. March and John F.J. Todd, CRC Press, Inc., copyright 1995.

Hitachi Spectrometer "Model M–8000 Hitachi LC3DQMS System" brochure (8 pages including cover and back) published Mar. 2000.

*Primary Examiner*—John R. Lee
*Assistant Examiner*—Christopher M. Kalivoda
(74) *Attorney, Agent, or Firm*—Ronald L. Wanke; Jenner & Block, LLC

(57) ABSTRACT

An ion trap mass spectrometer uses electrospray ionization to introduce multiply-charged positive ions in an axial direction into a quadrupole ion trap and glow discharge ionization to introduce singly-charged negative ions in a radial direction into the ion trap. Methods of controlling ion-to-ion charge transfer reactions include applying dipolar DC voltage across endcap electrodes to allow partial charge state neutralization reactions to occur between the positive and negative ions and then suspending further charge state neutralization reactions. The remaining ions can be further processed and transformed and a mass spectrum created by scanning a quadrupolar RF field.

25 Claims, 6 Drawing Sheets

METHODS AND APPARATUS TO CONTROL CHARGE NEUTRALIZATION REACTIONS IN ION TRAPS

TECHNICAL FIELD

The present invention relates to methods and apparatus to control charge neutralization reactions between positive ions and negative ions in ion traps used for mass spectrometry.

BACKGROUND OF THE INVENTION

Ion trap mass spectrometers, also known as quadrupole ion storage devices or Paul ion traps, use various combinations of RF and DC electric potentials applied to endcaps and ring electrodes which give rise to RF and DC electric fields that trap and manipulate ions. Various electric potentials are known including RF and DC quadrupolar and dipolar potentials. Electrospray ionization (ESI) and other ionization methods can produce multiply-charged analyte ions from large molecules including peptides and proteins and others. This permits certain analysis of high mass molecules by a mass spectrometer having a lower mass-to-charge range. It is also known to introduce counter ions of opposite charge, including singly-charged counter ions, which will react by ion/ion charge transfer reactions, including proton transfer reactions, to migrate the analyte ions to lesser multiple charged states which represent higher mass-to-charge ratios. However, it has been difficult to control the ion to ion transfer reactions so as to manipulate and/or control the ion/ion reactions for practical use in mass spectrometry.

One known method to selectively inhibit rates of ion/ion reactions in a quadrupole ion trap is to apply dipolar RF signals to the endcap electrodes to cause resonance excitation at or near the ion of interest. All of the higher charge state ions can undergo rapid ion/ion reactions until such time as they fall into the region of the Mathieu stability diagram where they become "parked" by virtue of the reduced ion/ion reaction rates for the accelerated charge state. This method is described by Scott A. McLuckey Gavin E. Reid and J. Mitchell Wells, in "Ion Parking During Ion/Ion Reactions In Electrodynamic Ion Traps", Analytical Chemistry, Vol. 74, Issue 2, pages 336–346, published Jan. 15, 2002.

SUMMARY OF THE INVENTION

The present invention includes new methods and apparatus to control charge neutralization reactions between positive ions and negative ions which are simultaneously trapped in a Paul type ion trap. The ion/ion reactions can be inhibited and/or suspended so as to allow further processing and/or analysis of the ion products. This is particularly useful for concentrating analyte ions in a particular charge state for subsequent processing such as purification, CID, and mass analysis. Such concentration is particularly useful for the analysis of mixtures of high mass molecules such as proteins.

It is an object of the present invention to provide new methods and apparatus for operating an ion trap to control the progression of the ion/ion charge transfer reactions between simultaneously-trapped positive and negative ions to facilitate further processing and mass analysis.

It is another object of the present invention to provide methods and apparatus for generating and using dipolar electrostatic (DC) fields in a manner to manipulate and control ion/ion reactions in an ion trap containing positive and negative ions.

It is a further object of the present invention to provide methods and apparatus to apply dipolar DC fields to suspend charge state neutralization reactions and quench further reactions in a manner controllable by an operator to select one or more target charge states for further processing and mass analysis.

DETAILED DESCRIPTION OF THE EMBODIMENTS

Figure 1:
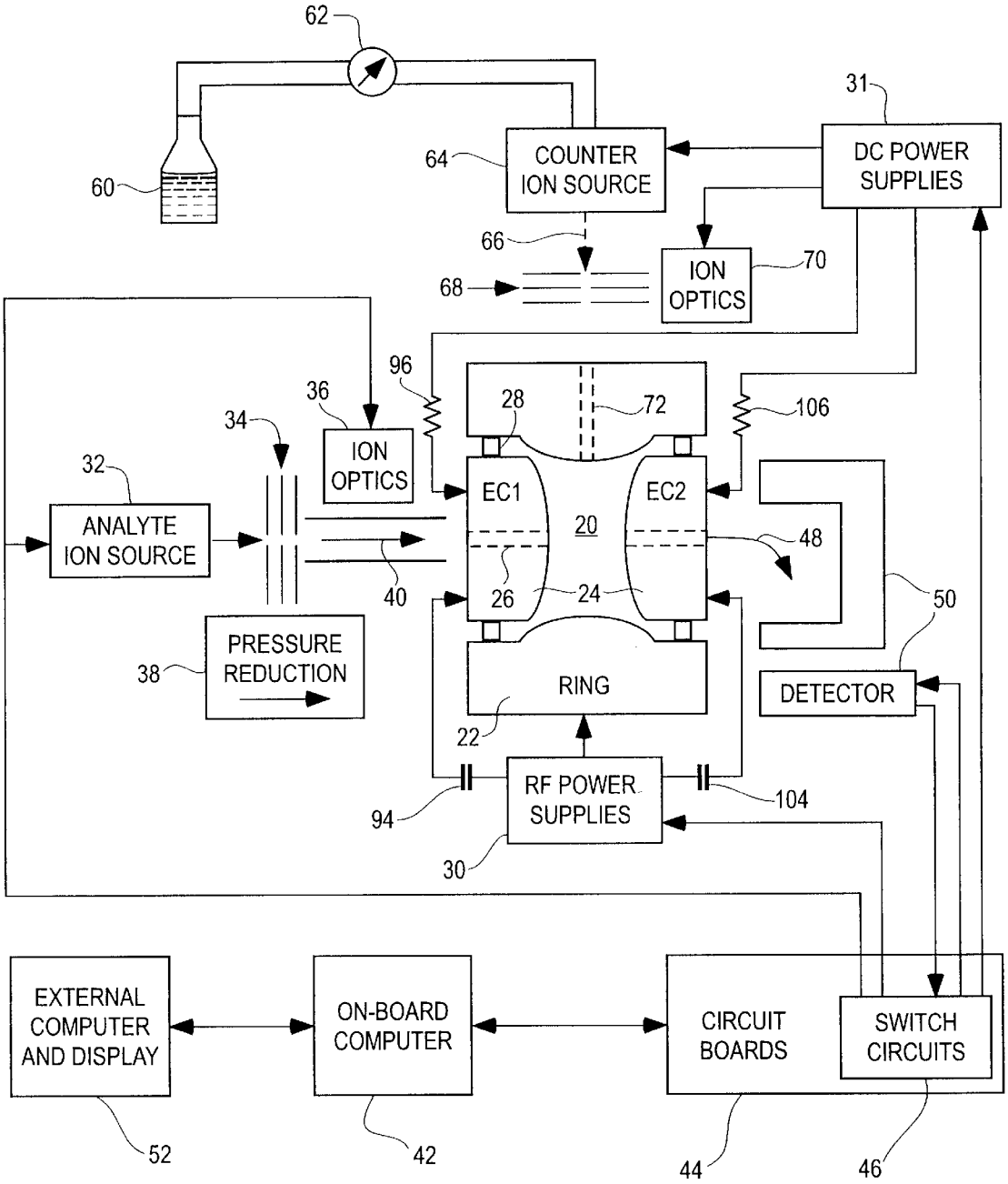
FIG. 1 is an overall block and schematic diagram of a quadrupole ion trap and associated control system in accordance with the present invention.

Turning to FIG. 1, a Paul type ion trap 20 includes an annular ring electrode 22 of radius $r_0$ and a pair of endcap electrodes 24 which can vary from each other due to asymmetric stretch and different size apertures. One endcap is labeled EC1, and the other is labeled EC2. Each endcap has aperture openings 26 for the passage of ions through the endcap. A pair of quartz insulating rings 28 electrically isolates the ring electrode 22 from the pair of endcap electrodes 24. The ring electrode 22 has an interior surface which obeys $r^2-2z^2=r_0^2$, or nearly so until it is truncated. The endcaps have interior surfaces which obey $r^2-2z^2=2z_0^2$ or nearly so until they are truncated. The endcaps 24 and ring 22 form a generally hyperbolic electrode structure which may be somewhat distorted or stretched as is well-known.

RF power supplies 30 generate several radio frequency (RF) signals coupled to the endcaps 24 and ring 22 to control the ion trap 20. One RF drive signal is applied to the ring electrode to establish within the enclosed volume a substantially quadrupolar RF electric field which can have superimposed thereon other higher multipole fields such as a hexapole field and/or an octopole field, etc. This substantially quadrupolar field has a variable RF voltage amplitude V at a frequency f such as 1 MHz. Ions having a specific range of mass-to-charge (m/z) ratio can be stably trapped inside the ion trap by the quadrupole RF field. Other electrode geometries are known which, together with applied RF signals, can also be used to trap ions in a substantially equivalent manner.

Quadrupolar electric fields can be formed by an infinite variety of electrode geometries with applied potentials, but the fields generally have a substantial component, E, which varies linearly with position, or, potentially, several such components. Mathematically, this linear component behaves as follows:

$$E=f(t)\{\alpha x+\beta y+\gamma z\}\text{where} \quad (1)$$

$$\alpha+\beta+\gamma=0 \text{ (to satisfy the Laplace Equation)} \quad (2)$$

in which f(t) is some periodic amplitude, and x, y and z represent the vector position in space where the field is to be evaluated. Similarly, a dipolar electric field will have a substantial component which is spatially homogenous (independent of position in the field) that may be time-varying.

DC power supplies 31 generate several direct current (DC) voltages coupled to the ion trap and ion optics. This can include an optional DC voltage of variable amplitude U which can be combined with the quadrupolar RF field to vary the operating and scan parameters for the ion trap 20 in a known manner.

An analyte ion source 32 creates analyte or sample ions which are electrostatically focused by DC voltages coupled to lenses 34 controlled by ion optics circuitry 36. Pressure reduction stages 38, illustrated diagrammatically, reduce the pressure from atmospheric of about 760 Torr at the input of the analyte ion source to a substantial vacuum of about $1.0\times10^{-4}$ Torr where a stream of analyte ions 40 enter the aperture 26 through the endcap EC1. Many different methods of forming and transferring multiply-charged analyte ions to the ion trap are known.

An on-board computer 42 controlled by firmware and software generates control signals to circuit boards 44 which generate the various signals for controlling the ion trap and its various operating parameters including temperature and the like. The circuit boards 44 include a variety of switch circuits 46 which generate switch signals coupled to circuits which apply signals to various electrodes within the instrument. The ion trap can perform, for example, collision induced dissociation (CID) of parent ions into daughter ions, and other types and higher orders of MS/MS analysis.

After manipulation of the ions in the ion trap, the RF power supplies 30 generate a quadrupolar RF scan voltage with an amplitude V increasing along a linear ramp in order to cause ions remaining within the trap to be ejected in mass sequential order including through the aperture 26 of the endcap EC2. The resulting ion exit stream 48 is deflected to a detector 50 such as a conversion dynode/photoelectron multiplier detector system. The current output of the detector 50 is coupled to the on-board computer 42 to record the resulting mass spectra. Typically, the on-board computer 42 communicates over a bus with an external computer 52 including a connected CRT display device for further analysis and/or display of the results. Other forms of mass-to-charge analysis are possible and are well known.

The overall system to the extent described above is known and available from several manufacturers. For example, the system can be an LC/3DQMS system, Model M-8000, made by Hitachi, Ltd. and distributed by Hitachi Instruments, Inc. of San Jose, Calif., the assignee of this application. This LC/MS/MS system is available with an Electrospray ionization (ESI) interface used herein for the analyte ion source 32. As is known, an ESI source provides multiply-charged ions from a sample to be analyzed, and the resulting analyte ions have a broad range of charge states. For example, the electrospray can produce positive analyte ions having charge states from +1 through +25 or higher, but the electrospray of an analyte such as DNA or RNA can produce multiply-charged negative analyte ions of high charge states.

Figure 3:
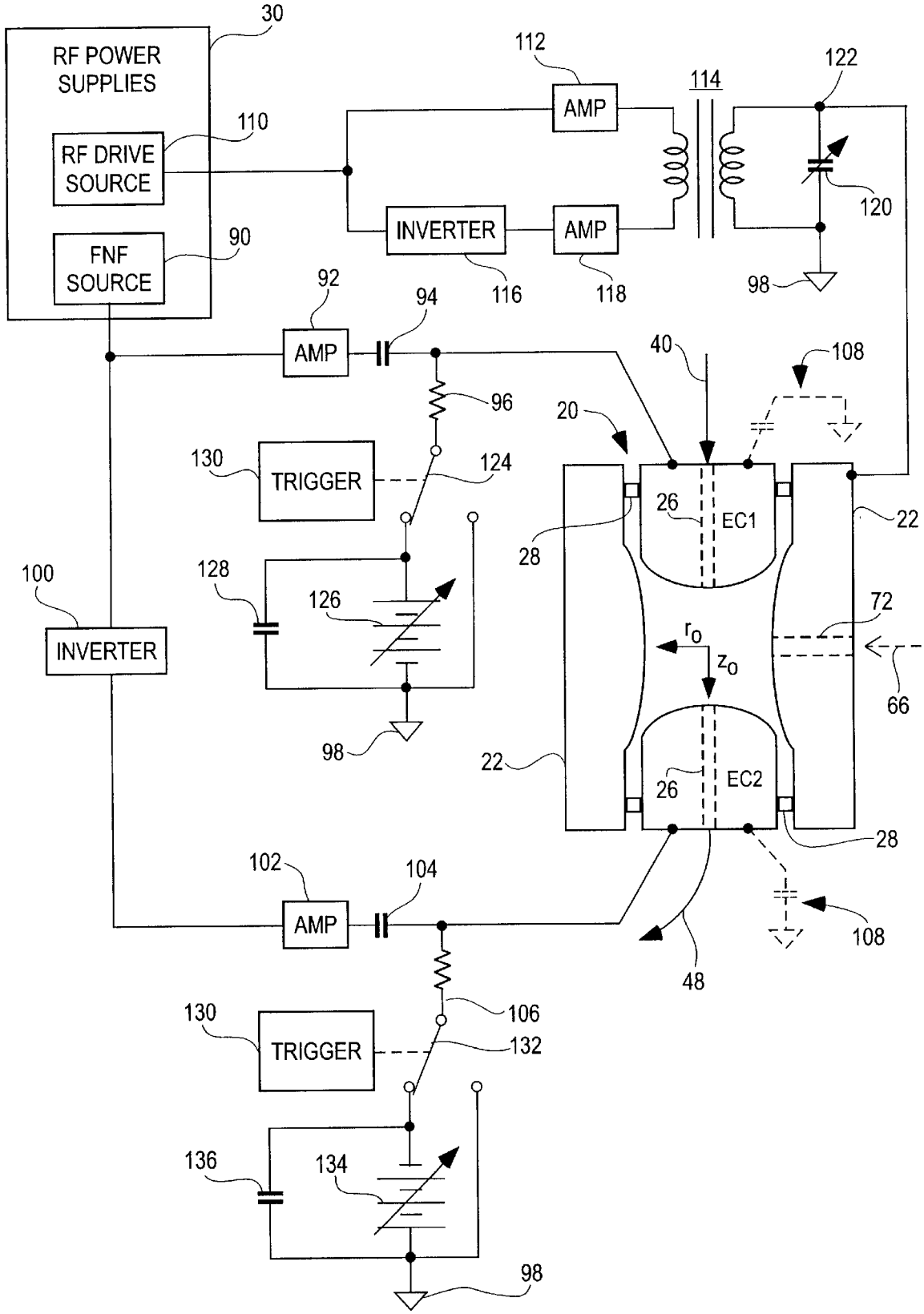
FIG. 3 is a partly block and partly schematic diagram of a portion of the control system for applying dipolar DC and dipolar RF signals and quadrupolar RF drive to the ion trap of FIG. 1.
Figure 5:
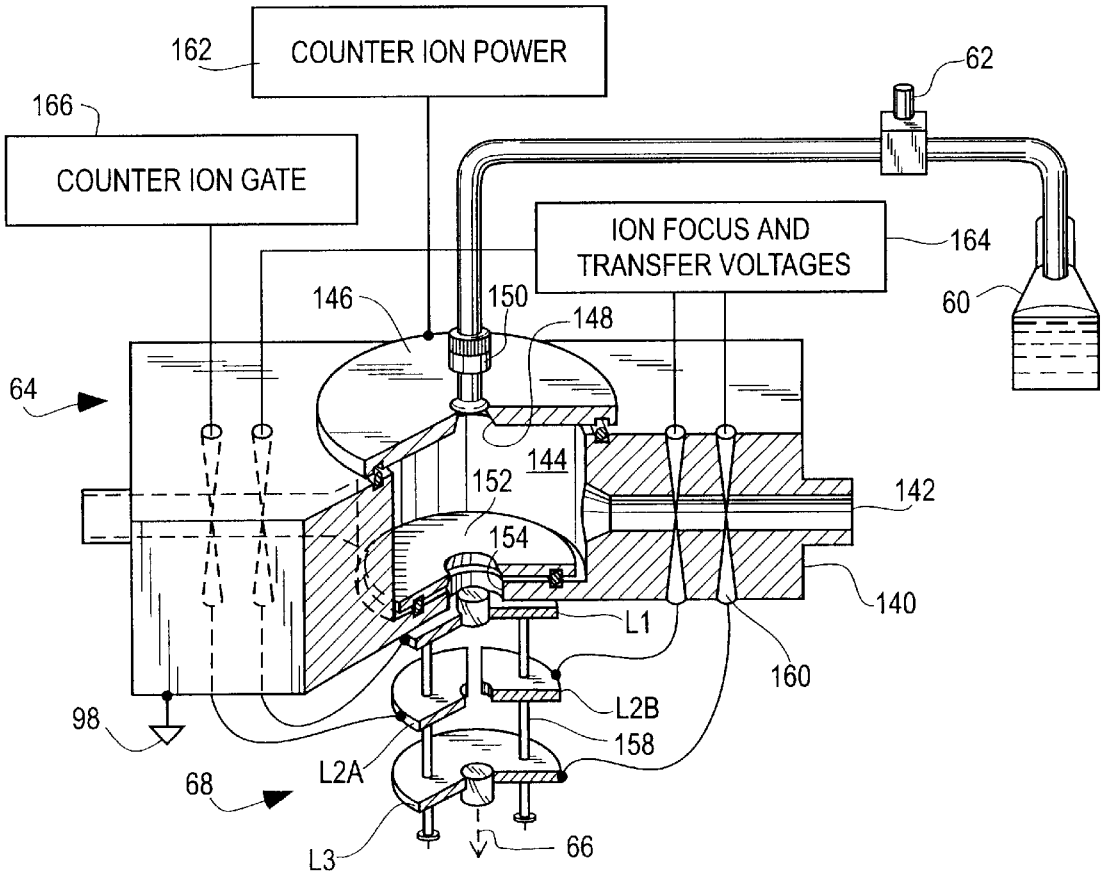
FIG. 5 is a partly block and partly schematic diagram of the counter ion source and associated DC power supplies of FIG. 1.

The system described above is modified by the addition of further apparatus as shown in FIGS. 1, 3 and 5, and is operated in accordance with the process steps of the remaining figures. A reagent reservoir 60 supplies a reagent sample through a precision leak valve 62 to a counter ion source 64 which produces ions of counter or opposite charge to those produced by the analyte ion source 32. When the analyte ion source 32 produces positive ions, then the counter ion source 64 should produce negative ions. Depending on the counter ion source, these counter ions may be singly charged such as having a −1 charge or may be multiply-charged. The counter ion source 64 can be a glow discharge ionization (GDI) source to be explained later.

A stream 66 of singly-charged negative counter ions from source 64 are electrostatically focused by lenses 68 controlled by ion optics circuitry 70. An aperture 72 extends radially through the ring electrode 22 so that the counter ion stream 66 enters the interior of the ion trap 20 along a radial direction r. The radius of the annular ring 22 is $r_0$. As seen in FIG. 3, the multiply-charged positive analyte ions 40 enter the ion trap along an axial axis z. The distance from the center of the ion trap to the endcap EC2 is $z_0$ (or slightly more for a stretched trap). The direction of introduction of either the analyte ions or the counter ions can be varied.

The RF power supplies 30 and DC power supplies 31 are operated to simultaneously trap the analyte ions and the counter ions within the center of the ion trap 20. In addition, the DC power supplies 31 provide dipolar DC voltages which serve to substantially separate in space the positive ions from the negative ions to inhibit ion/ion reactions between the positive ions and the negative ions, as will be explained.

Figure 2A:
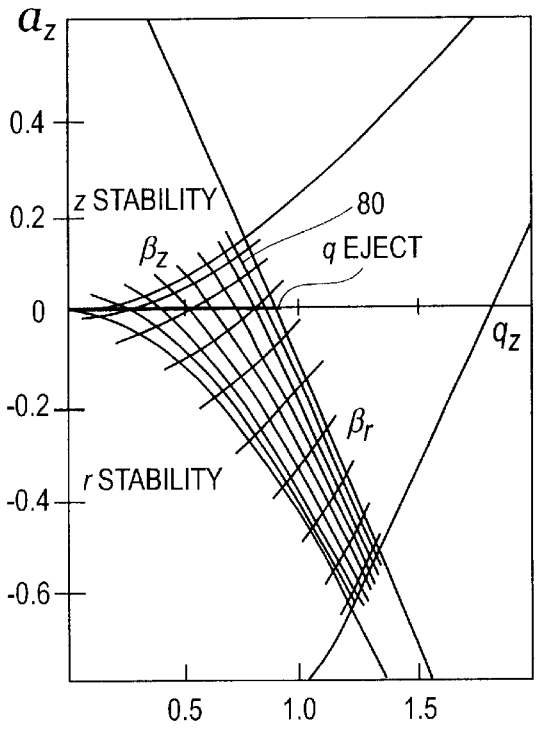
FIGS. 2*a* to 2*c* are Mathieu stability diagrams for the ion trap of FIG. 1.
Figure 2B:
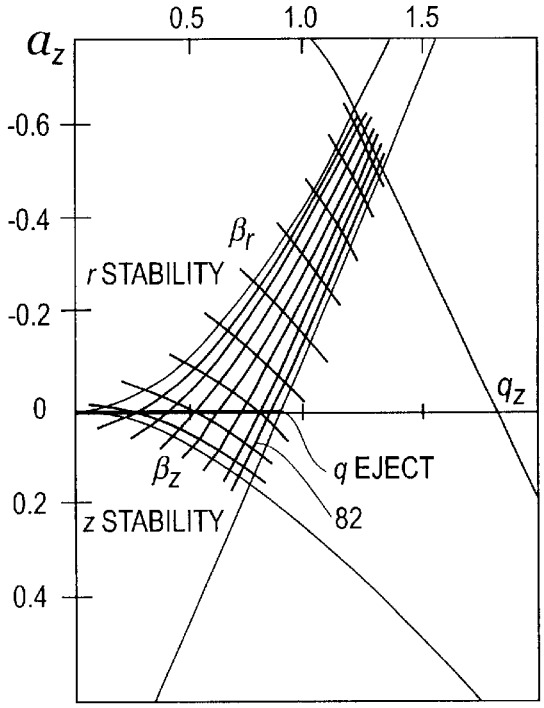
Figure 2C:
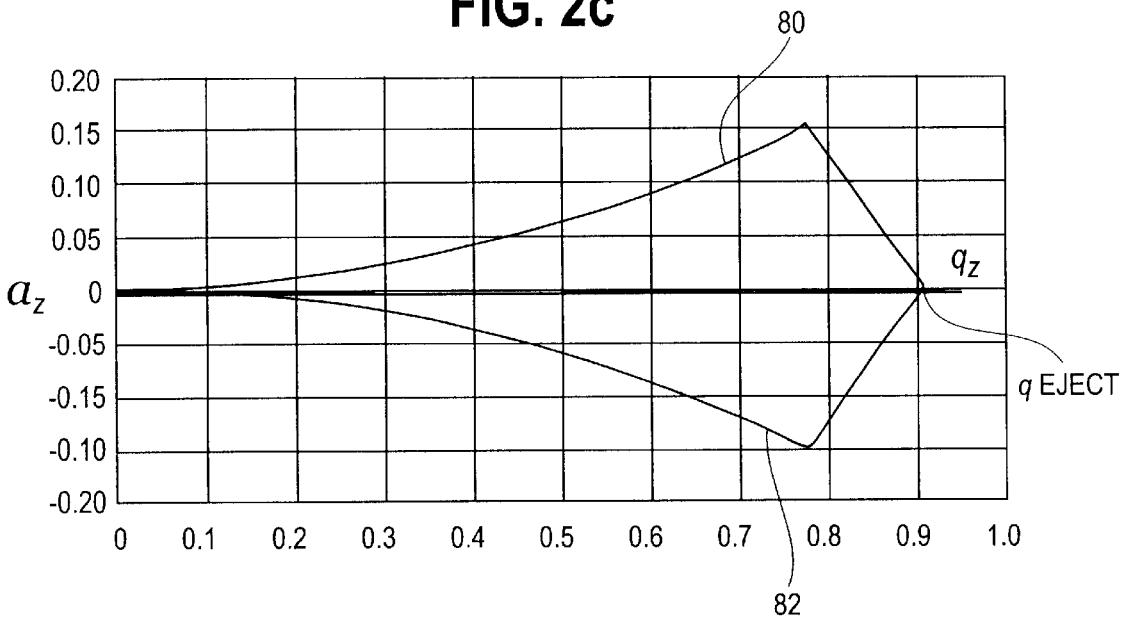

FIGS. 2*a* to 2*c* are Mathieu stability diagrams showing the regions of stability for the three-dimensional ion trap 20 about $a_z$ and $q_z$ axes. FIG. 2*a* indicates the stability diagram for positive ions, which in an exemplary embodiment herein are multiply-charged analyte ions. FIG. 2*b* is a mirror image and shows the stability diagram for negative ions, which in an exemplary embodiment are singly charged reagent ions of −1 charge. The parameters $a_z$ and $q_z$ for these Mathieu stability diagrams are defined as:

$$a_z = \frac{-8qU}{mr_0^2\omega^2} \quad (3)$$

$$q_z = \frac{4qV}{mr_0^2\omega^2} \quad (4)$$

where

V=magnitude of quadrupolar RF voltage

U=amplitude of quadrupolar DC voltage q=charge born by the charged particle.

m=mass of charged particle $r_0$=radius of ring electrode from center

ω=angular frequency of quadrupole RF voltage

For any particular ion, the values of $a_z$ and $q_z$ must be within the stability envelope if the ion is to be trapped within the quadrupolar RF and quadrupolar DC fields.

A bounded region 80 shown in FIG. 2*a* above the $a_z$=0 axis is stable for positive ions, and overlaps a corresponding region of stability in FIG. 2*b* for negative ions. A bounded region 82 shown in FIG. 2*b* below the $a_z$=0 axis is stable for negative ions, and overlaps a corresponding region of stability in FIG. 2*a* for positive ions. FIG. 2*c* is an expanded Mathieu stability diagram and illustrates that positive ions and negative ions will be simultaneously stable and trapped if they map within the envelopes of the regions 80 and 82. The ion trap 20 of FIG. 1 is operated by adjusting the quadrupolar RF drive parameter V so that at least some of the positive analyte ions from source 32 and at least some of the negative counter ions from source 64 map within the regions 80 and 82 of FIG. 2C. A typical quadrupolar RF frequency is 1 MHz or so. The quadrupolar DC component U is typically set to 0 volts.

FIG. 3 illustrates in more detail a portion of the circuit for applying dipolar DC and dipolar RF signals across the endcaps EC1 and EC2 and quadrupolar RF drive to the ring of the ion trap 20. The RF power supplies 30 include a source 90 of supplemental RF signals having an adjustable frequency range, also called FNF and/or supplemental AC having a variable frequency. FNF is an abbreviation for Filtered Noise Fields, which are supplemental RF signals generated with a selectable narrow to wide bandwidth which span a frequency range from about 10 KHz to about half of the RF drive frequency such as 400 KHz, have a variable amplitude from a few millivolts (mV) to ten volts, and also can include frequency notch(es) within the bandwidth.

The supplemental RF waveform generator 90 generates broad or narrow band signals depending on the purpose of the dipolar RF field. The dipolar FNF fields may be used to eject unwanted ions from the trap as, for example, when isolating a parent ion for subsequent MS/MS analysis. In this case, the supplemental RF signal is broadband ranging from about 10 kHz up to about one-half of the quadrupolar RF Drive frequency (about 500 kHz) with a notch at the axial frequency of the parent ion. For collision induced dissociation or CID, the FNF is typically narrowband and ranges in bandwidth from a single frequency to a few kHz. During mass analysis, the supplemental RF signal is typically a single frequency corresponding to a particular point along the $q_z$ axis of the stability diagram. Manipulation of trapped ions for isolation and CID using dipolar RF fields such as FNF is well known.

As seen in FIG. 3, the FNF source 90 is coupled through an amplifier 92 and a blocking capacitor 94 to the endcap EC1. A resistor 96 can be directly connected to ground 98, also called AG for analog ground or chassis ground. The FNF source 90 is also coupled through an inverter 100 and amplifier 102 and blocking capacitor 104 to the other endcap EC2. A resistor 106 can be directly connected to ground 98. Each endcap presents a small stray capacitance to ground, as represented by the dashed lines 108. Typical values for blocking capacitors 94 and 104 are 2.2 uF and for resistors 96 and 106 are 50 ohm. Amplifiers 92 and 102 are formed by operational amplifiers which are matched in gain and characteristics. The resulting circuit applies signals to EC1 and EC2 which are 180° out of phase thereby creating a substantially dipolar RF electric field in the interior of the trap.

The RF power supplies 30 also include an RF drive source 110 for generating an RF signal applied to the ring to trap ions. The source 110 is coupled through an amplifier 112 to one side of input windings of a transformer 114, and through an inverter 116 and amplifier 118 to the other side of the input windings of transformer 114. A variable capacitor 120 across the output windings is adjusted to establish resonance of the circuit with the applied signal. One side 122 of the output windings is coupled to the ring electrode 22, and the other side of the output windings is coupled to ground 98.

The circuit of FIG. 3 to the extent described above is known. This circuit is modified by a pair of manually adjustable DC voltage sources connected with opposite polarities, i.e. dipolar, to the endcaps EC1 and EC2. More particularly, a switch 124 has one switch terminal connected to a DC voltage supply 126 having a manually preset adjustable voltage. An optional capacitor 128 can be in parallel therewith to stabilize the DC voltage during switching. A trigger circuit 130 controls the switch 124 for connecting one polarity DC voltage, of an amplitude manually preset by the operator, to the endcap EC1.

Similar circuitry of opposite polarity is added to the other channel for endcap EC2. Namely, a switch 132 has one switch terminal connected to a separate adjustable DC voltage source 134 connected with ground 98. The magnitude of DC source 134 can be manually preset by the operator. An optional parallel capacitor 136 can be used to stabilize the fixed DC voltage during switching. Switch 132 is controlled by the trigger circuit 130. The adjustable DC power supply 134 has an opposite polarity to the supply 126, and therefore couples the opposite polarity DC voltage to endcap EC2. Typical values for the capacitors 128 and 136 are 100 uF.

Switches 124 and 132 can be ganged together, and are controlled by the common trigger circuit 130 which is under software control. While EC1 is shown biased to a positive DC voltage and EC2 is shown biased to a negative DC voltage, hence dipolar, the polarities can be reversed. To achieve truly dipolar DC, the two DC supplies 126 and 134 should apply voltages of the same absolute magnitude but of opposite polarity. Any DC potential difference across the endcaps will create a substantially dipolar DC electric field within the trap. In the exemplary embodiment, equal but opposite DC potentials are used to avoid the introduction of a quadrupolar DC field into the interior of the trap. In alternate embodiments, the software control can permit individual and independent adjustment of the +DC magnitude and of −DC magnitude for each endcap. Or, one endcap can be kept at ground potential of 0 volts.

Figure 4:
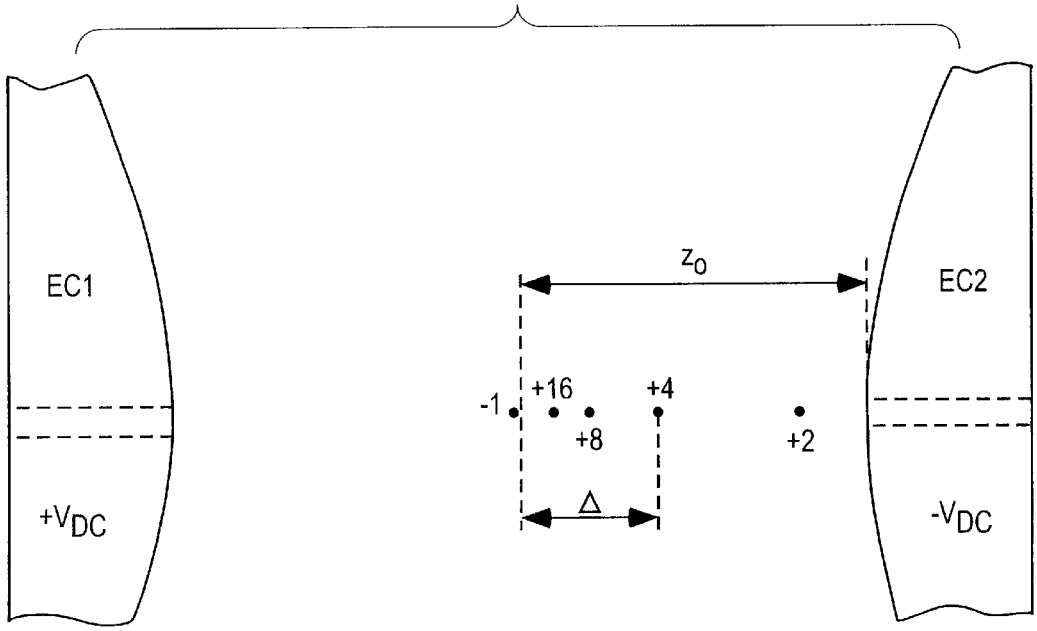
FIG. 4 is an exploded view showing axial dispersion of positive ions and negative ions under the influence of dipolar DC between the endcaps of the ion trap of FIG. 1.

FIG. 4 shows schematically several axial displacements for different charge states of multiply-charged positive analyte ions and singly-charged negative counter ions when $+V_{DC}$ is applied to endcap EC1 and $-V_{DC}$ is applied to endcap EC2. By way of example, the relative axial positions of the +2, +4, +8 and +16 analyte ions (not all of which may be present at one time) and the −1 counter ion is illustrated for one set of trapping and dipolar DC parameters. The distance $z_0$ represents the fixed distance from the ion trap center to the endcap EC2 (or slightly more for a stretched trap). A displacement Δ represents the variable distance from the ion trap center to a center of orbit for an ion of a particular charge state. The displacement Δ is shown illustratively in the figure for a +4 analyte ion. As can be seen, positive ions are pulled towards endcap EC2 due to the attraction of $-V_{DC}$, whereas the negative ions are shifted slightly away from the geometric center towards the $+V_{DC}$ potential on endcap EC1. Furthermore, lower charge states such as +2 and +4 (which represent higher m/z ions) are shifted more away from the geometric center of the trap, and hence further away from possible reactions with the −1 counter ions.

The absolute magnitude of $V_{DC}$ can be adjusted, along with certain other parameters, to control the amount of displacement Δ for analyte ions of a particular charge state. Greater distances of Δ move analyte ions further away from the center, and when sufficiently far enough away will suppress reactions with counter ions. For the illustrated condition in which the +2 charge state is located close to endcap EC2, those +2 ions are sufficiently far away from the −1 counter ions to be unable or unlikely to react with the counter ions. In contrast, the much higher charge states, such as +16, are significantly closer to the −1 counter ions and will react as the orbits overlap.

To selectively halt the CSM process at a particular charge state, the operator adjusts the control system to preselect certain time periods of interaction, the magnitude of $V_{DC}$, and certain other parameters to be explained, so as to effectively select a target charge state. The relationship between the parameters to be controlled can be derived in the following manner. For quadrupolar RF drive voltage V applied to the ring electrode, with quadrupolar DC magnitude U=0, and the dipolar $V_{DC}$ applied to the endcaps, the force, F, exerted on ions of charge q by the dipolar $V_{DC}$ electric field is approximately given as:

$$F = \frac{qfV_{dc}}{z_0} \tag{5}$$

where q is the charge of the particular ion and f is a constant which accounts for the particular geometry of the endcap and ring electrodes. The displacement Δ of the center of an ion's orbit from the center of the trap in such a field is approximately:

$$\Delta = \frac{F}{m\omega_z^2} \tag{6}$$

By substituting the following equations:

$$\omega_z^2 \approx \frac{2V^2}{\left(\frac{m}{q}\right)^2 r_0^4 \Omega^2} \tag{7}$$

$$(m/q)^* = \frac{2V}{0.908 z_0^2 \Omega^2} \tag{8}$$

$$r_0^2 \approx 2z_0^2 \tag{9}$$

where (m/q)* is the low mass cutoff at the specified trapping conditions, the resulting equation can be stated as:

$$\frac{\Delta}{z_0} \approx \left[\frac{f}{0.908}\right]\left[\frac{m/q}{(m/q)^*}\right]\left[\frac{V_{dc}}{V}\right] \tag{10}$$

The $\Delta/z_0$ ratio, which is also illustrated graphically in FIG. 4, represents the relative displacement of ions along the $z_0$ axis of the ion trap. When the displacement Δ is equal to the fixed distance $z_0$ to endcap EC2, then $\Delta/z_0=1$ and those ions hit the endcap and are lost from the trapping field. For a $\Delta/z_0$ of less than one, the ions are located various distances from center such as illustrated in FIG. 4.

In order to manipulate the CSM process for precise control of a target charge state, the parameters in the above equation are adjusted in value so that ions to be migrated (e.g. +16, +8, etc.) are located relatively close to the −1 counter ions, and the target charge state of the ions to be retained in the trap (e.g. +2) is moved to have a displacement A sufficiently far away from the center so as to halt reactions with the counter ions. The primary parameters to be varied for an ion trap of fixed physical dimensions are the magnitude of the dipolar DC voltage, i.e. the magnitudes of $+V_{DC}$ and $-V_{DC}$, the quadrupolar RF voltage V, and the quantity of ions allowed to accumulate during the time periods of ion introduction. The control system of the present invention allows an operator to vary and preset those parameters so as to control the CSM process in order to substantially suspend ion/ion reactions at any desired target charge state.

FIG. 5 illustrates in more detail the counter ion source 64 and associated apparatus. The counter ion source 64 can be a glow discharge ionization (GDI) device having a manifold chamber 140 with a vacuum port 142 connectable to a rough vacuum pump. Chamber 140 is electrically connected to ground 98. A central region 144 in the center of the chamber is maintained at a rough vacuum pressure such as 400 to 800 mTorr. A metal inlet plate 146, electrically isolated from the chamber by an O-ring, has a small diameter opening contiguous with an open cone shaped expander region 148 which opens into the center chamber 144. The reagent sample 60 is connected by a pipe through a precision leak valve 62 to an ultraTorr connector 150 to pass the reagent through the expander region 148 and into the central region 144. Opposite the inlet plate 146 at the bottom of the chamber and sealed by an O-ring is an outlet plate 152 having a center small diameter opening contiguous with a cone shaped expander region 154.

A switchable counter ion power supply 162 when gated on generates a DC discharge voltage which is directly connected to the inlet plate 146. This DC voltage can be from −350 to −500 volts, and will cause glow discharge ionization or arcing to occur within the discharge chamber 144 and create negative reagent ions having a single negative charge of −1.

A series of electrostatic lens electrodes 68 are spaced by insulating rods 158 away from the exit opening 154 for the negative reagent ions created by the glow discharge. A first focusing lens L1 is annular and includes a hollow center sleeve opposite the cone expander opening 154. Downstream from lens L1 is a pair of split lenses L2A and L2B which are electrically isolated from each other. A final lens L3 is annular with a hollow center sleeve to cause negative ions 66 to be electrostatically focused onto the radial aperture 72 in the ring electrode. Four insulated feed-through conductors 160 couple DC voltages through the chamber 140 to the exit side for connections to the downstream lenses L1, L2A, L2B and L3.

An ion focus and transfer voltage supply 164 generates several static DC voltages necessary for electrostatic focusing of the negative ions. Typically, lens L1 is connected to 500 volts, lens L2B is connected to 200 volts, and lens L3 is connected to 50 volts. Gate lens L2A is connected to a switchable counter ion gate DC voltage supply 166 which can be switched between 0 volts (ground) and 200 volts. When the GDI source is to be gated off, the lens L2A is grounded. When the GDI source is to be gated on to allow the negative ions to be pushed outward along stream 66, the lens L2A is switched to 200 volts, i.e., the same static DC voltage on the lens L2B.

With the apparatus operated as described, an ion population consisting of multiply-charged analyte ions and singly-charged counter ions is established in the ion trap 20. In the absence of any intervention, these ions will react via charge exchange, usually proton exchange, wherein a proton from a positively charged species is transferred to a negatively charged species, until either the positive or negative ions are depleted. Positive, multiply-charged ions are usually formed by multiple additions of protons to a neutral molecule. Thus, the mass of the ion, m, is simply related to the mass of the neutral molecule, M, the mass of the proton, $m_p$, and the number of protons, n, that were added as follows:

$$m=M+nm_p \tag{11}$$

Furthermore, the charge on the ion, q, is the charge of a proton, e, times the number of protons added, n. Then, the mass-to-charge ratio of the ion, m/q is stated as:

$$m/q = \frac{[M + nm_p]}{ne} \tag{12}$$

As a result of a single proton transfer reaction, a new ion is formed having a different mass-to-charge ratio, (m/q)', as follows:

$$(m/q)' = \frac{[M + (n-1)m_p]}{(n-1)e} \tag{13}$$

In a mass spectrometer, such a shift in mass-to-charge ratio of many such ions is observable as a reduction of the signal at m/q and the emergence or enrichment of a signal at (m/q)'. Another proton transfer reaction creates yet another new ion with mass-to-charge ratio (m/q)" and so on:

$$(m/q)'' = \frac{[M + (n-2)m_p]}{(n-2)e} \tag{14}$$

This process can be continued as long as negative counter ions are present even to the point that the neutral molecule is once again formed and thereupon lost from the ion trap. Table 1 gives a numerical example for Cytrochrome C (M=12360.1 amu) where the charge state or number of protons n, attached to the neutral molecule is shown in one column and the corresponding mass-to-charge ratio m/z of the ions is shown in the second column. The mass of the protons is taken, for simplicity to be 1 amu.

TABLE 1

| Charge State (n) | Mass-To-Charge Ratio |
|---|---|
| 1 | 12361.10 |
| 2 | 6181.05 |
| 3 | 4121.03 |
| 4 | 3091.03 |
| 5 | 2473.02 |
| 6 | 2061.02 |
| 7 | 1766.73 |
| 8 | 1546.01 |
| 9 | 1374.34 |
| 10 | 1237.01 |
| 11 | 1124.65 |
| 12 | 1031.01 |
| 13 | 951.78 |
| 14 | 883.86 |
| 15 | 825.01 |
| 16 | 773.51 |
| 17 | 728.06 |
| 18 | 687.67 |
| 19 | 651.53 |
| 20 | 619.01 |
| 21 | 589.58 |
| 22 | 562.82 |
| 23 | 538.40 |
| 24 | 516.00 |
| 25 | 495.40 |

As is well known, the initial charge state distribution can be roughly represented by the mass spectrum of the multiply-charged analyte population in the absence of any ion/ion reactions. When negative counter ions are allowed to react with the analyte ions for some time prior to mass analysis, the observed charge state distribution is seen to have shifted or migrated to lower charge states (higher mass-to-charge m/z ratios) as shown for Cytochrome C in FIG. 7*b*. As such, this process is sometimes referred to as "Charge State Migration" or "CSM". Finally, it should be noted that instrument calibrations will affect observed m/z values which may deviate somewhat from the calculated values.

One known method of intervention, described by Scott A. McLuckey et al. in "Ion Parking During Ion/Ion Reactions in Electrodynamic Ion Traps", Analytical Chemistry, 74(2), 336–346, 2002, is to drastically reduce the rate of the charge transfer reaction for one or more charge states through application, during the reaction step, of a dipolar RF electric field at or near resonance for the ions of the selected charge state(s). The dipolar RF causes the selected ions to oscillate with relatively large amplitudes and, more importantly, to be moving relatively quickly when in close proximity to the counter ions that are held in the center of the trap. The rate constant for the charge transfer reaction for the selected ions is dramatically reduced in such a situation leading to a virtual suspension of the CSM process at the selected state(s). In contrast, in this invention, a dipolar DC electric field is employed to disperse the various charge states of the analyte ions along the direction of the applied field and also to separate the counter ions therefrom. By varying one or more of several parameters, a particular charge state can be selected where the CSM process essentially halts owing to the spatial separation from the counter ions.

To explain the process of charge state migration or CSM, the following example is given for an analyte ion having a +12 charge state and an m/z of 1031.01 as indicated in the above Table 1. An ion/ion proton transfer reaction with a −1 counter ion transforms the ion in the +12 charge state into an ion in the +11 charge state with a new observable m/z of 1124.65. A further ion/ion reaction with another −1 ion again migrates the analyte ion to n=+10, and an observable m/z of 1237.01. Continuing ion/ion reactions thus cause the observed m/z to move upwardly, such as from an m/z of about 1031 to about 1125 and then about 1237 and so forth. Unless controlled or inhibited in some manner, the analyte ions will continue to migrate to higher m/z until the neutral molecule is formed or the practical trapping limit of the trap is reached and hence become lost. However, the use of dipolar DC of properly chosen amplitudes, following the process steps given herein, will suspend the migration before analyte ions are lost in the manner described above. As a result, the ions from a given analyte molecule can be concentrated in a single charge state for subsequent processing at relatively high sensitivity.

Figure 6:
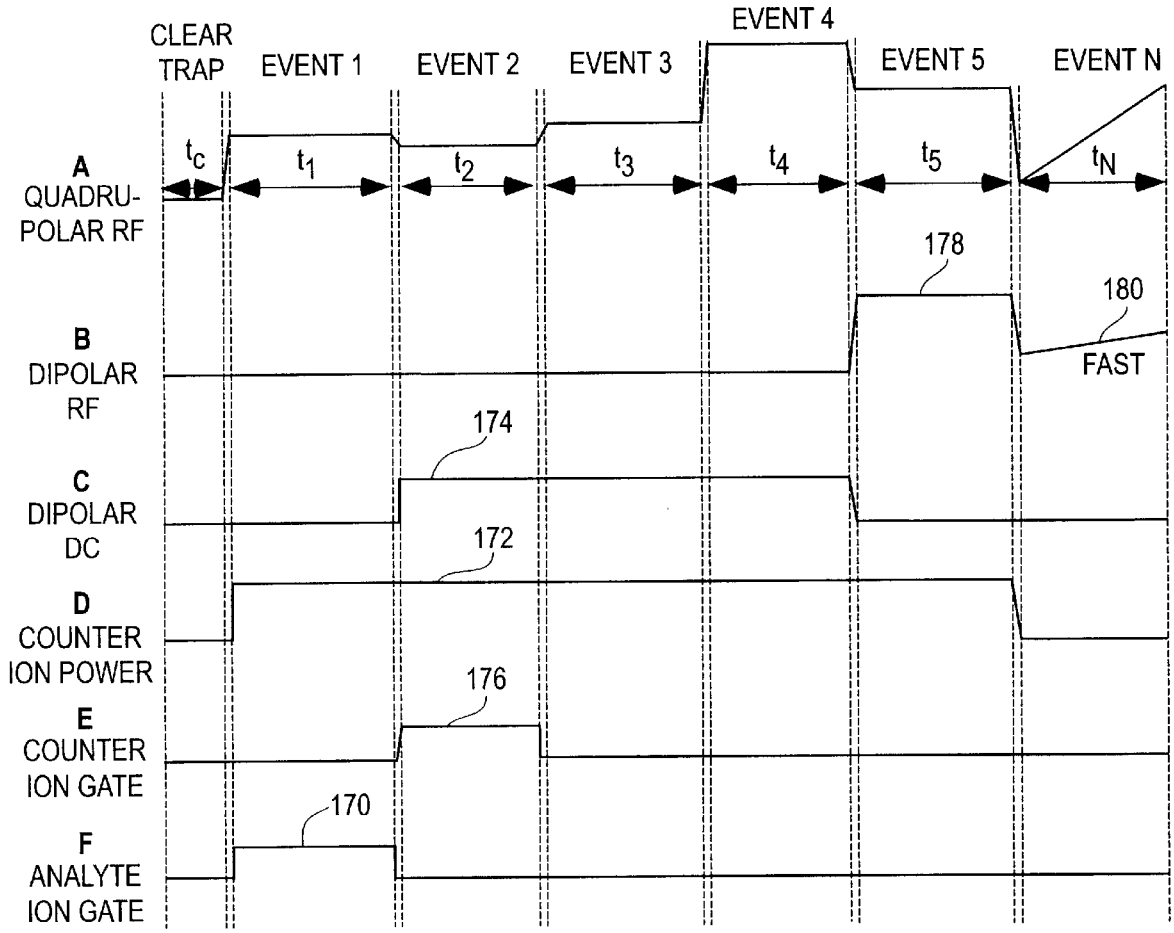
FIG. 6 shows several related timing diagrams for operating the ion trap in accordance with the invention.

FIG. 6 shows the timing diagrams, labeled A through F, for the various applied signals for operating the ion trap 20 in accordance with the present methods of using dipolar DC in a manner to control charge neutralization reactions between the analyte positive ions and counter negative ions. Waveform A shows a quadrupolar RF drive applied to the ring by RF drive source 110 of FIG. 3 and having an amplitude (vertical axis) of V. Waveform B shows a dipolar RF signal across the endcaps, and waveform C shows a dipolar DC signal across the endcaps, as generated by the circuit of FIG. 3. Waveform D shows the counter ion power generated by supply 162 in FIG. 5. Waveform E shows the counter ion gate produced by circuit 166 in FIG. 5. Waveform F shows the gate signal supplied by switch circuits 46 of FIG. 1 to the analyte ion source 32. Each event or step occurs during a corresponding time period t (horizontal axis) which is variable and controlled by the software and firmware in the on-board computer 42. The individual time periods t are not shown to scale, and generally can vary substantially between adjacent steps or events. Desirably each time period t can be adjusted in duration by an operator, in addition to having preselected values controlled by the software to perform certain standard operations. Between the time periods t, a small time interval exists to provide a transition time sufficient for the waveform pulses to change states and stabilize between each event.

Turning more specifically to the methods of operating the ion trap using the FIG. 6 timing waveforms, the ion trap is initially cleared during a clear trap period $t_c$. During period $t_1$, the quadrupolar RF drive A is adjusted in amplitude V so as to trap the positive analyte ions, and is adjusted during $t_2$ so as to simultaneously trap the positive analyte ions and negative reagent ions by maintaining the ions within the stability envelopes 80 and 82 of FIG. 2C. The analyte ion gate signal F generates a pulse 170 which goes high during $t_1$ to gate on the analyte ion source 32 and thus cause multiply charged positive analyte ions to accumulate in the ion trap during Event 1. Time period $t_1$ is typically several hundred ms. Also during $t_1$, the counter ion power signal D generates a high going pulse 172 to gate on the counter ion power supply 162 of FIG. 5 to begin the glow discharge. However, no counter ions pass to the ion trap since the counter ion gate signal E remains low during period $t_1$.

During time period $t_2$, the dipolar DC signal C generates a high going pulse 174 to activate the trigger blocks 130 of FIG. 3 and thereby apply dipolar DC across the endcaps EC1 and EC2. During the same time period $t_2$, the counter ion gate signal E generates a high going pulse 176 which causes power supply 166 of FIG. 5 to switch from ground to the same static DC voltage on lens L2B. This gates on the GDI source and causes singly charged negative counter ions to pass into and accumulate in the ion trap 20 during Event 2. Preferably, the analyte ions and counter ions are accumulated in sequential steps, but the order of introduction can vary as will be explained. It is possible to eliminate use of the gate signal E and instead switch on and off the counter ion power pulse 172 to control counter ion accumulation. However, use of a gate signal 176 to control the gate electrostatic lens L2A of the GDI device is preferable to produce a more stable operation for introducing or ceasing counter ion accumulation in the ion traps. Time period $t_2$ of counter ion accumulation is typically 10 ms to several 10 s of ms and can be selected by an operator.

In the exemplary embodiments, at least one of the analyte ions and counter ions are introduced radially and the other axially. The axially introduced ions should be introduced first during period $t_1$, and then the radially introduced ions should be introduced second during period $t_2$ and simultaneous with the presence of the dipolar DC field. For this embodiment, the dipolar DC goes on during radial ion accumulation $t_2$ and is continuously on during and spans the partial neutralization reaction and suspension period $t_3$ and quench period $t_4$ and then is terminated. As will be explained later, the order as well as the direction of introduction of the analyte ions and counter ions can be changed from the example illustrated.

During time period $t_3$, which typically is several hundred ms to several thousand ms, the quadrupolar RF drive A can be adjusted to have a higher amplitude V in order to set the low m/z cutoff to a higher value. Importantly, the dipolar DC signal 174 remains high during $t_3$ so that the ion cloud of the selected charge state, or m/z, will remain largely spatially separated from that of the counter ions thereby inhibiting further CSM reactions. The reason is that positive analyte ions of higher mass-to-charge will move towards one endcap and will orbit more away from the negative reagent ions which are biased by the dipolar DC towards the other endcap as shown in FIG. 4. The amplitude of the adjustable dipolar DC is set to a low voltage which typically is several hundred millivolts to several volts in order to displace the orbits, but not eject the ions, which are to be maintained within three dimensional trapping field. As multiply-charged positive ions undergo ion/ion reactions with single charged negative ions, the positive ions migrate to one lesser positive charge state, and then migrate again and again to lower charge states and hence higher m/z ratios. The negative counter ion population is partially depleted in this process which probably serves to further increase the separation of the remaining charged ion populations.

As shown by equation (10), the displacement of an ion from the center of the trap is related to the m/q of the ion, the low m/z cutoff, the dipolar DC voltage, and the amplitude V of the quadrupolar RF drive signal. Additionally, the duration of the reaction event $t_3$ as well as the initial sizes of the two ion populations will also affect the extent of the reactions. In consequence, all of these parameters or any combination thereof may be varied by the operator to select the charge state or m/q at which the migration is effectively halted. Desirably, the operator has control over most or all of these parameters which can be preselected by the operator and then implemented by the software controlling the operation of the ion trap.

During time period $t_4$, the dipolar DC pulse 174 remains high so that the dipolar DC field continues in the ion trap. The voltage V of the quadrupolar RF drive A is raised substantially to raise the low m/z cut-off of the ion trap. This drives the counter ions out of the ion trap to prevent any further charge state migrations. After expulsion of the counter ions, at the end of Event 4, the dipolar DC pulse 174 is terminated as it is no longer necessary for controlling the ion/ion reactions. Thus, Event 4 is a quench operation to eliminate the counter ions while leaving the remaining analyte ions in the ion trap.

During time period $t_5$ and any further time periods needed, further processing of the remaining analyte ions can begin. For example, cooling can occur. As another example, the voltage V of the quadrupolar RF can be changed to adjust the low m/z cut-off and the dipolar RF signal can generate a pulse 178 to perform a desired operation such as isolation or CID.

During a final time period $t_N$, the remaining analyte ions which have been processed are scanned and ejected in mass sequential order to create a mass spectrum. For this purpose, the quadrupolar RF drive A is reduced and then increased along a ramp V. Additionally, the dipolar RF signal B generates a pulse 180 which also ramps upward with time. The single dipolar RF frequency is chosen to correspond to a specific point along the $a_z$=0 axis of the stability diagram within the stable trapping region. Thus, a resonance point or hole in the stability diagram is established at a particular $q_z$ and the ramping of the RF drive A causes ions of successively higher m/z to arrive at that point whereupon they are ejected to the detector. The resonant point is chosen so as to achieve a given scanning m/z range for the trap. Other means of generating a mass spectrum exist and are known to those skilled in the art.

Figure 7A:
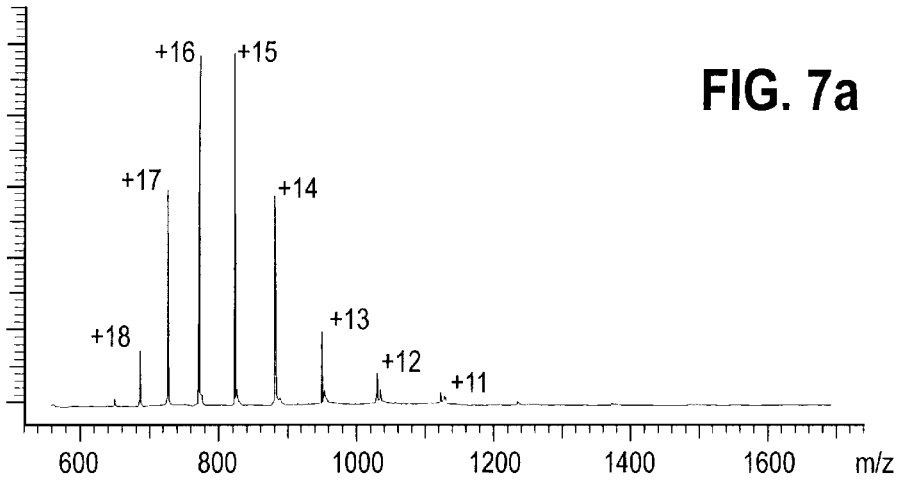
FIGS. 7*a* to 7*c* illustrate mass spectra produced by operating the ion trap in accordance with the timing signals of FIG. 6.
Figure 7B:
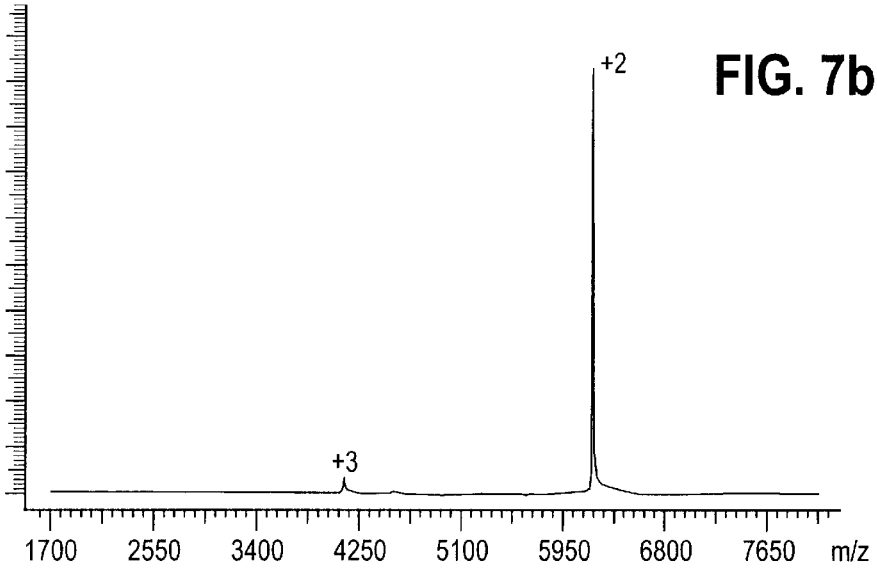
Figure 7C:
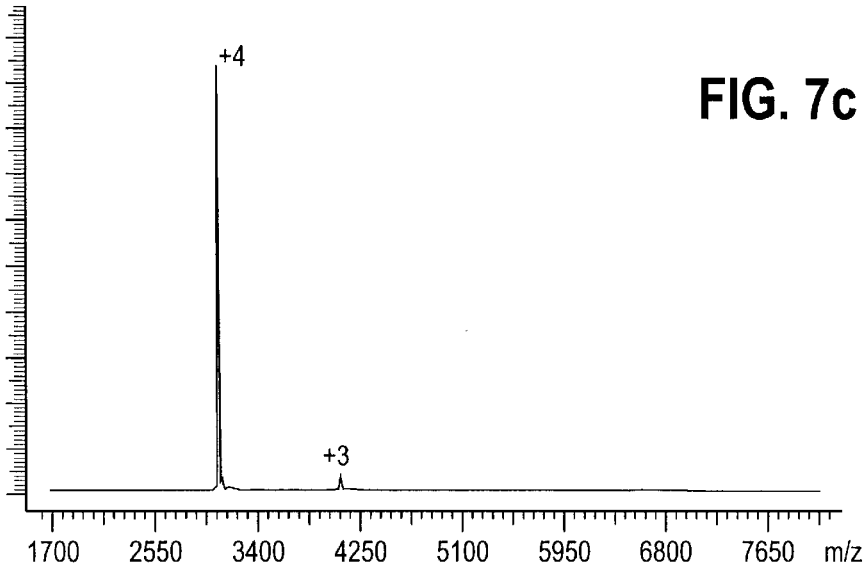

The mass spectrum resulting from operating the ion trap following the steps of FIG. 6 are illustrated in FIGS. 7*a* to 7*c*. Each spectrum has a horizontal axis representing the m/z values and a vertical axis representing intensity or abundance. The peaks have been labeled with the corresponding charge states for the particular analyte ions under investigation. The ion trap described herein was operated using as the analyte Cytochrome C having a molecular weight of 12360.1 amu. An electrospray of this analyte resulted in numerous of the high charge states listed in Table 1. The reagent used was perfluoro-dimethyl-cyclohexane (C8F16) having a molecular weight of 400 amu. A glow discharge ionization of this reagent resulted in singly-charge counter ions having a −1 charge state observable at various m/z values owing to fragmentation within the source.

FIG. 7*a* illustrates the beginning mass spectrum of trapped ions, i.e., when the counter ion gate remains off during time period $t_2$. Peaks occurred for +11 through +18 charge states of the analyte ions. The peaks were of medium intensity for +14 and +17 analyte ions, and of high intensity for +15 and +16 analyte ions centered around 800 m/z. Absent a method to suspend CSM, the charge state migration reactions would cause all analyte ions to become lost by mechanisms previously described. In contrast, the ion trap can be operated following the methods of the present invention to select any desired target charge state for the analyte ions, for example as +2 or +4, and migrate the distribution of higher charge state analyte ions to this target charge state in order to concentrate the analyte ions for further processing.

FIG. 7*b* illustrates operating the ion trap to cause the mass spectrum of FIG. 7*a* to migrate to a desired target of +2 analyte ions. It should be noted that the m/z scale in FIG. 7*b* has been shifted to a higher range from about 1700 to 7650 m/z. Thus, the m/z scale of FIG. 7*b* is essentially an upper extension of the lower m/z scale of FIG. 7*a*. The values of the dipolar DC and other operating parameters based on equation (10) for the $\Delta/z_0$ ratio are preselected by an operator to cause partial charge state neutralization reactions to begin and then be suspended at a substantially higher m/z value corresponding to the target +2 charge state for analyte ions. This target charge state was produced by adjusting the parameters for operating the ion trap to have the following values in Table 2:

TABLE 2

| |
|---|
| $t_1$ = 300 ms |
| $t_2$ = 65 ms |
| $t_3$ = 1500 ms |
| $t_4$ = 10 ms |
| $t_5$ = 100 ms |
| low mass cut-off = 100 m/z |
| for Events 2 and 3 |
| $\pm V_{dc}$ = 0.76 volts |
| for Events 2 to 4 |

Other target charge states for the analyte ions can be selected by an operator by varying these parameters. FIG. 7*c* illustrates operating the ion trap to migrate the mass spectrum of FIG. 7*a* to a target charge state of +4 analyte ions. The parameters for operating the ion trap were adjusted to the following values listed in Table 3:

TABLE 3

| |
|---|
| $t_1$ = 300 ms |
| $t_2$ = 85 ms |
| $t_3$ = 1500 ms |
| $t_4$ = 10 ms |
| $t_5$ = 100 ms |
| low mass cut-off = 100 m/z |
| for Events 2 and 3 |
| $\pm V_{dc}$ = 1.52 volts |
| for Events 2 to 4 |

In the exemplary embodiment, the analyte ions are introduced axially while the counter ions are introduced radially. However, virtually any direction can be chosen for introduction of either ion stream. Furthermore, the two streams are introduced at distinct times and with analyte ions entering first in the experimental sequence in the exemplary embodiment. This is not a requirement and analyte and counter ion streams can enter the trap at the same times, partially or completely, or their orders can be reversed. In the illustrated embodiment, the dipolar DC is on whenever both types of ions are present in the trap, and dipolar DC is known to degrade or enhance the trapping efficiency of ions introduced in any direction other than strictly radially. No such effect has been observed for ions introduced radially. Thus, care needs to be taken in situations where ions with an axial component of velocity enter the trap when ions of the opposite polarity are already trapped. When one set of ions is introduced axially, the dipolar DC pulse 174 can be off during the axial introduction, as shown.

Both the analyte ions and the counter ions can be introduced radially. Both sets of ions could enter radially through the same hole, or alternatively, two sets of radial openings can extend through the ring electrode 22 at offset angles from each other. When both the analyte ions and the counter ions are introduced radially, then the dipolar DC pulse 174 of FIG. 6 can be pulsed on any time, and the pulse 174 does not need to coincide with the counter ion gate pulse 176. Furthermore, the dipolar DC pulse 174 can be left on during later time periods for ejection if the dipolar DC field is oriented to push the ions to be analyzed in the direction of the detector.

The counter ion source 64 in the exemplary embodiments is a glow discharge ionization (GDI) source. It is generally desirable to leave the glow discharge running at all times in order to achieve a more stable source. However, the glow discharge can disturb certain types of ion detectors resulting in a large baseline noise. When the ion detector 50 of FIG. 1 is a photoelectron multiplier detector, then it is desirable to use two triggered power supplies 162 and 166 as seen in FIG. 5, and terminate the power pulse 172 before scan period $t_n$ when the ion detector is being utilized. However, if the ion detector 50 is a different type, such as a conversion dynode/electron multiplier design, then the GDI power supply can be left on at all times, and using the gate pulse 176 to control when the counter ions are to be introduced into the ion trap.

Further changes and modifications will be apparent to those of ordinary skill in the art.

What is claimed is:

1. A method of controlling an ion trap comprising the steps of generating an RF field for simultaneous trapping of positive ions and negative ions, trapping first ions having charge states of one polarity by the RF field, trapping second ions having charge states of opposite polarity by the RF field, at least one of the first ions and second ions being in a multiply-charged state, applying a DC field to spatially separate the first ions and second ions to permit charge state neutralization reactions to partially migrate the multiply-charged state to at least one target lesser charge state having a higher mass-to-charge ratio.

2. The method of claim 1 in which the DC field has an amplitude adjustable by an operator to select different target charge states having different mass-to-charge ratios.

3. The method of claim 1 in which a low mass cutoff of the ion trap is altered by an operator to select different target charge states.

4. The method of claim 1 in which the DC field has a dipolar DC component to inhibit further charge state neutralization reactions upon migration to the target lesser charge state.

5. The method of claim 4 in which the ion trap has at least a pair of spaced electrodes, and the dipolar DC component is created by applying a first DC voltage of an adjustable amplitude to one of the electrodes and applying a second DC voltage of different but adjustable amplitude to the other of the electrodes.

6. The method of claim 5 in which the first DC voltage and second DC voltage are of equal magnitude but opposite polarity and are adjustable by an operator to alter an end point of migration.

7. The method of claim 6 in which the ion trap has a pair of endcap electrodes corresponding to the pair of spaced electrodes and has a ring electrode, and the dipolar component is created by applying a positive polarity DC voltage to one endcap electrode and a negative polarity DC voltage to the other endcap electrode with the positive and negative polarity DC voltages having the same absolute magnitude.

8. The method of claim 1 in which an operator can vary at least a time period of applying the DC field to vary the target lesser charge state.

9. The method of claim 1 including establishing an accumulation time period for accumulating of first ions and second ions and a separate time period for applying the DC field which overlaps at least a portion of and extends beyond the accumulation time period.

10. The method of claim 1 in which trapping first ions and trapping second ions occurs sequentially in time, suppressing the DC field during trapping first ions, and applying the DC field at least during trapping second ions.

11. The method of claim 1 in which the ion trap has a pair of endcap electrodes having an axial opening and a ring electrode having a radial opening, the trapping first ions occurs by introducing first ions through one of the axial opening and radial opening, and the trapping second ions occurs by introducing second ions through the other of the axial opening and radial opening.

12. The method of claim 11 in which ions introduced through the axial opening occurs during a first period of accumulation and ions introduced through the radial opening occurs during a separate period of accumulation.

13. The method of claim 1 in which the at least one of the first ions and second ions have a plurality of different multiply-charged states to create a distribution of multiply-charged states.

14. The method of claim 13 in which at least one of the first ions and second ions are created by electrospray ionization of an analyte sample to thereby produce a broad distribution of higher multiply-charged states.

15. The method of claim 1 in which another of the first ions and second ions are created by glow discharge ionization of a reagent to produce at least a singly charged state.

16. The method of claim 15 including generating a DC gating signal applied to an electrode downstream of the glow discharge ionization to pass the singly charged ions during an accumulation period and to thereafter block passage of the singly charged ions.

17. The method of claim 1 including quenching of one of the first ions and second ions after applying the DC field to prevent further charge state neutralization reactions to thereby maintain the target lesser charge state.

18. The method of claim 17 in which quenching includes continuing the DC field and adjusting the RF field to eliminate the one of the first ions and second ions.

19. A method of controlling an ion trap comprising the steps of generating an RF field for simultaneous trapping of positive ions and negative ions, accumulating first ions having charge states of one polarity within the RF field during a first time period, accumulating second ions having charge states of opposite polarity within the RF field during a second time period, one of the first ions and second ions being in a multiply-charged state and the other of the first ions and second ions being in at least a singly charged state, applying a DC field for a third time period which extends beyond the second time period to disperse the first ions and second ions within the RF field to partially permit and then suspend charge state neutralization reactions to thereby migrate the multiply-charged state to lesser charge states having higher mass-to-charge ratios, and varying at least one of the third time period, the RF field, and the DC field to select a particular one of the lesser charge states as a target charge state.

20. The method of claim 19 in which the step of varying includes allowing an operator to select an adjustable amplitude for the DC field as one parameter to select the target charge state.

21. The method of claim 19 in which the step of varying includes allowing an operator to select adjustable durations for the third time period and at least one of the first and second time periods as parameters to select the target charge state.

22. The method of claim 19 including expulsion of the other ions having at least the singly charged state during a fourth time period following the third time period to quench the reactions and thereby maintain the target charge state.

23. The method of claim 22 in which expulsion occurs by adjusting the low mass-to-charge cut-off for the RF field to eliminate the singly charged ions.

24. The method of claim 19 in which the ion trap has at least a pair of spaced electrodes, and the DC field is created by applying a positive polarity DC voltage of an adjustable amplitude to one of the electrodes and applying a negative polarity DC voltage of an adjustable amplitude to the other of the electrodes.

25. The method of claim 19 in which the third time period begins during the first time period or second time period so that the DC field overlaps accumulating of at least certain ions and extends until at least suspension of the charge state neutralization reactions.

* * * * *